US005484197A

United States Patent [19]

Hansen et al.

[11] Patent Number: 5,484,197

[45] Date of Patent: Jan. 16, 1996

[54] RELEASABLE LATCH FOR A TELESCOPING SLIDE ASSEMBLY

[75] Inventors: Carl E. Hansen, Greenfield; James D. Hobbs, Plainfield, both of Ind.

[73] Assignee: General Devices Co., Inc., Indianapolis, Ind.

[21] Appl. No.: 158,524

[22] Filed: Nov. 29, 1993

Related U.S. Application Data

[63] Continuation-in-part of Ser. No. 38,171, Mar. 29, 1993.

[51] Int. Cl.[6] ..... A47B 88/10; F16C 21/00

[52] U.S. Cl. ..... 312/334.12; 384/19

[58] Field of Search ..... 312/334.7, 334.12, 312/334.47, 334.32, 334.44; 16/82

[56] References Cited

U.S. PATENT DOCUMENTS

| | | |
|---|---|---|
| 2,319,555 | 5/1943 | Premo . |
| 2,496,673 | 2/1950 | Nielsen . |
| 2,728,626 | 12/1955 | Gussack . |
| 2,788,253 | 4/1957 | Gussack . |
| 2,848,294 | 8/1958 | Sandberg . |
| 3,035,873 | 5/1962 | Fall . |
| 3,059,978 | 10/1962 | Fall . |
| 3,092,429 | 6/1963 | Barnes . |
| 3,142,517 | 7/1964 | Ward . |
| 3,450,446 | 6/1969 | Fall et al. . |
| 3,464,744 | 9/1969 | Fall . |
| 3,485,539 | 12/1969 | Fall et al. . |
| 3,488,097 | 1/1970 | Fall . |
| 3,521,939 | 7/1970 | Fall et al. . |
| 3,679,275 | 7/1972 | Fall et al. . |
| 3,687,505 | 8/1972 | Fall et al. . |
| 3,701,577 | 10/1972 | Fischer . |
| 3,738,716 | 6/1973 | Lambert . |
| 3,776,608 | 12/1973 | Fall et al. . |
| 3,801,166 | 4/1974 | York . |
| 3,869,184 | 3/1975 | Lambert et al. . |
| 3,937,531 | 2/1976 | Hagen et al. . |
| 3,950,040 | 4/1976 | Fall . |
| 4,004,841 | 1/1977 | Vander Ley . |
| 4,089,568 | 5/1978 | Fall . |
| 4,101,178 | 7/1978 | Adams et al. . |
| 4,200,342 | 4/1980 | Fall . |
| 4,549,773 | 10/1985 | Papp et al. . |
| 4,560,212 | 12/1985 | Papp et al. . |
| 4,872,734 | 10/1989 | Rechberg . |

FOREIGN PATENT DOCUMENTS

| | | |
|---|---|---|
| 2532532 | 3/1984 | France . |
| 803331 | 10/1958 | United Kingdom . |

*Primary Examiner*—Stephen C. Pellegrino
*Assistant Examiner*—Nancy Mulcare
*Attorney, Agent, or Firm*—Barnes & Thornburg

[57] ABSTRACT

A telescoping slide assembly includes a latch blade pivotably mounted on an intermediate slide member, a latching lip on a stationary slide member, and a cam on a load-carrying slide member. The latch blade engages the latching lip automatically to block movement of the intermediate slide member relative to the stationary slide member toward a fully retracted position. The cam on the stationary slide member engages and pivots the latch blade to a position disengaging the latching lip in response to movement of the load-carrying slide member relative to the intermediate and stationary slide members toward a fully retracted position so that the intermediate slide member is released from latching engagement with the stationary slide member and free to move toward its fully retracted position.

40 Claims, 5 Drawing Sheets

RELEASABLE LATCH FOR A TELESCOPING SLIDE ASSEMBLY

This application is a continuation-in-part of U.S. application Ser. No. 08/038,171 filed on Mar. 29, 1993.

BACKGROUND AND SUMMARY OF THE INVENTION

The present invention relates to telescoping slide assemblies having interconnected stationary, intermediate, and chassis slide members that slide relative to each other between a fully extended position and a fully retracted position. In particular, the invention relates to a latch mechanism for locking the intermediate slide member to the stationary slide member to prevent inadvertent retraction of the intermediate slide member. More particularly, the invention relates to latch mechanisms that are releasable by movement of the chassis slide member relative to the intermediate slide member to provide uninterrupted retraction of the slide assembly between the fully extended position and the fully retracted position.

A conventional telescoping slide assembly typically includes a stationary slide member, a chassis slide member, and an intermediate slide member. The intermediate slide member is positioned and configured to move the chassis slide member toward and away from the stationary slide member so that an object (e.g. drawer, equipment rack, platform, etc.) supported by the chassis slide member can be moved into and out of a cabinet or other housing.

Typically, a pair of telescoping slide assemblies are positioned in side-by-side spaced-apart parallel relation so that either a chassis platform or one or more pieces of equipment can be carried on the two side-by-side chassis slide members. It is also common to use a pair of telescoping slide assemblies to support a cabinet drawer between a retracted position inside the cabinet and an extended position outside the cabinet.

The stationary slide member is typically mounted to a fixed frame to anchor the slide assembly. The frame could be a cabinet, a truck bed, or any other suitable platform. For example, it is known to use telescoping slide assemblies to slide heavy pieces of equipment into and out of a truck bed.

Various kinds of equipment or loads can be anchored to the movable chassis slide members so that such loads can be moved easily relative to the truck bed or the like during telescoping extension and retraction of the intermediate and chassis slide members in each slide assembly relative to the stationary slide members that are anchored to the truck bed. Typically, a telescoping slide assembly is extended and retracted manually by an operator and thus must be capable of moving heavy loads easily and quickly under the control of an operator during loading of equipment onto the truck and unloading of equipment from the truck.

It is known to provide locking interconnections between each of the three slide members so that extension or retraction of the slide members relative to each other can be prevented. Since these locking interconnections must generally be manually engaged and disengaged, separate manual unlocking actions are required before such a drawer or equipment can be retracted. The use of a locking mechanism to prevent relative movement of two sliding tracks until manual release of the locking mechanism is known. See, for example, U.S. Pat. No. 4,200,342 to Fall et al.

Telescoping slide assemblies are able to retract to move the equipment or load from the extended position to a retracted position. Again, the operator initiates the retraction process by actuating a release mechanism to allow the chassis slide member to retract relative to the intermediate slide member. Typically, when the chassis slide member reaches its fully retracted position, the operator must actuate the release mechanism a second time to release the intermediate slide member for retraction relative to the stationary slide member. In many instances, the need for a second actuation of the release mechanism is a nuisance. Thus, telescoping slide assemblies that provide mechanisms for allowing the slide members to fully retract without stopping at a partly retracted position would be an improvement over conventional slide assemblies.

Releasable lock-out latch mechanisms for allowing a slide assembly to retract to a fully retracted position without stopping at a partly retracted position are known. See, for example, U.S. Pat. Nos. 4,549,773 and 4,560,212, both to Papp et al. The Papp et al. '773 and '212 patents disclose a releasable lock out latch coupled to the intermediate slide member and positioned to extend from the inner end (in direction of retraction) of the intermediate slide member. A portion of the latch is biased by a spring so as to extend into the path of the chassis slide member. Unfortunately, by extending from the inner end of the intermediate slide member, the lock-out latch increases the length of the slide mechanism. Moreover, the latch is susceptible to movement against the force of the biasing spring due to vibrations or jostling of the slide assembly to release the slide members inadvertently for retraction relative to each other.

An improved releasable lock-out latch mechanism would not add to the overall length of the slide assembly. The improved latch would also positively couple the slide members together in an extended position, thereby avoiding inadvertent release of the slide mechanism.

According to the present invention, a latch mechanism is provided for use with a telescoping slide assembly having interconnected stationary, intermediate, and chassis slide members that are movable between a fully retracted position and a fully extended position. The latch mechanism includes blade means for locking the intermediate slide member in the fully extended position relative to the stationary slide member. Lip means is formed on the stationary slide member to provide a catch for the blade means. The blade means is pivotally coupled to the intermediate slide member and positioned on the intermediate slide member for movement through an aperture formed in the intermediate slide member during pivoting movement of the blade means relative to the intermediate slide member. The blade means includes notch means for engaging the lip means formed on the stationary slide member to prevent movement of the intermediate slide member relative to the stationary slide member in a first direction. Biasing spring means is coupled to the intermediate slide member for normally urging the blade means in a downward direction to engage the lip means.

The chassis slide member includes camming means for lifting the notch means out of engagement with the lip means to allow the intermediate slide member to retract relative to the stationary slide member. Ramp means formed on the blade means engages the camming means to lift the notch means out of engagement with the lip means in response to retraction of the chassis slide member relative to the intermediate slide member.

In preferred embodiments of the invention, the ramp means includes a ramping edge formed on the blade means and configured to face a downward and extending direction opposite to the first direction. As the camming means moves in a retracting direction, the camming surface engages the ramping edge and the blade means is lifted upwardly, disengaging the notch means from the lip means.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
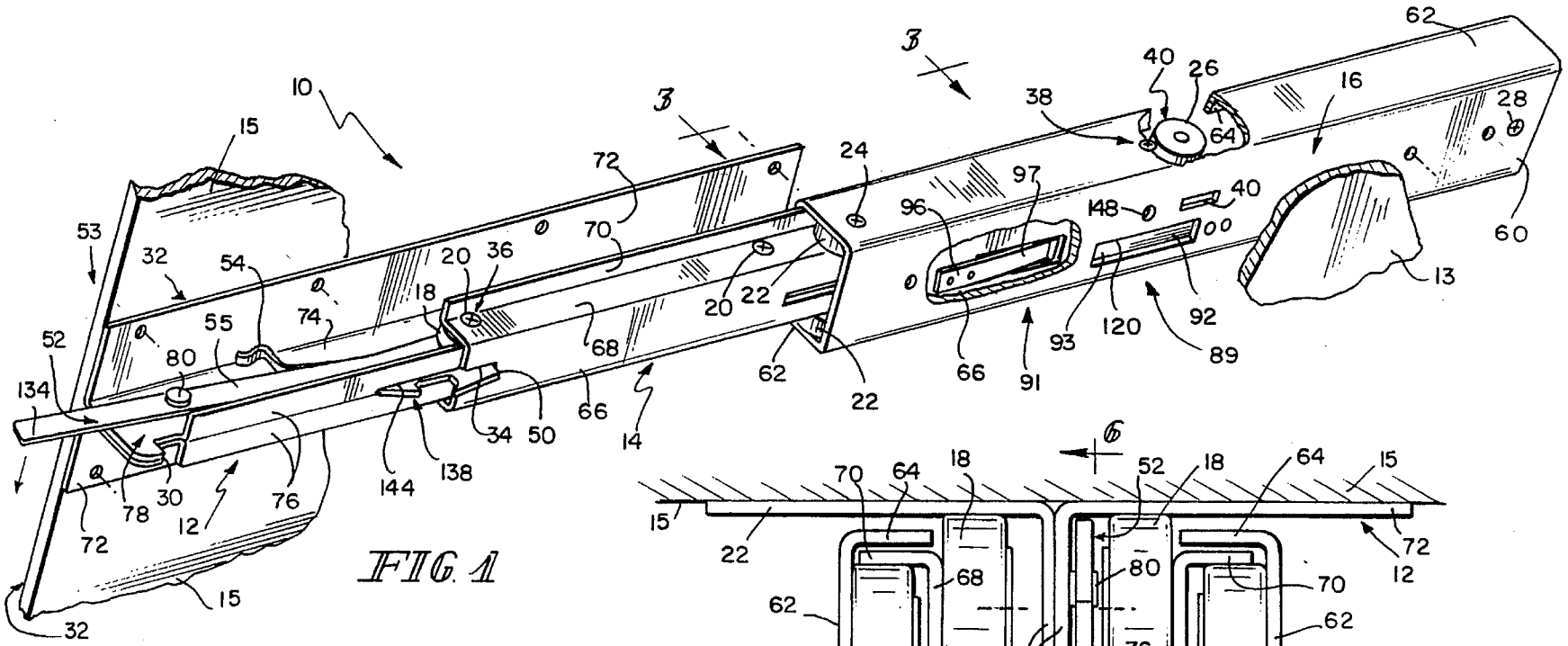
FIG. 1 is a perspective view of a telescoping slide assembly showing three connected slide members arranged in a fully extended position.
Figure 2:
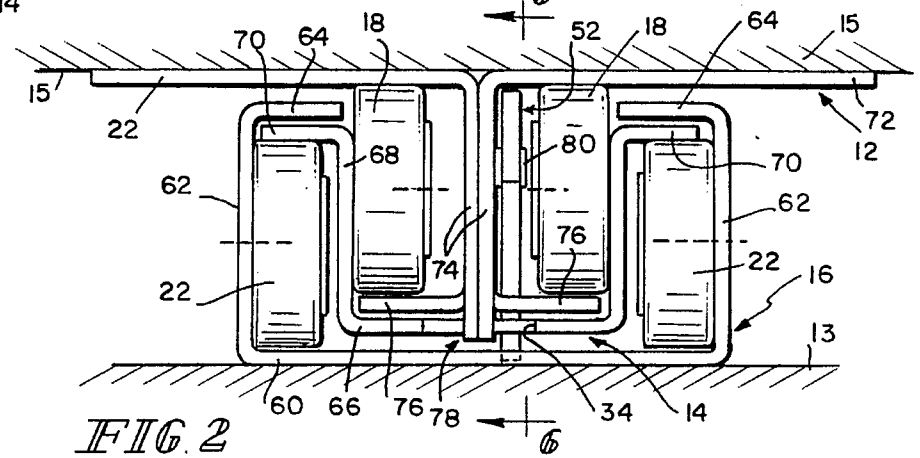
FIG. 2 is an end view of the telescoping slide assembly of FIG. 1 showing a stationary slide member mounted on a frame, a chassis slide member carrying a work piece and a pivotable locking lever, and an intermediate slide member therebetween.

The telescoping slide assembly 10 illustrated in FIG. 1 includes three nested and interconnected slide members 12, 14, and 16. A stationary slide member 16 is configured to be mounted on a truck bed 13 or other platform as shown in FIGS. 1 and 2. An intermediate slide member 14 is nested in, and capable of back and forth motion relative to the stationary slide member 16. A chassis slide member 12 is configured to support a piece of equipment 15 to be moved as shown in FIGS. 1 and 2. The chassis slide member 12 is nested in, and capable of back and forth motion relative to the intermediate slide member 14.

The chassis slide member 12 is supported for sliding movement in the intermediate slide member 14 by rollers 18 which are coupled to the intermediate slide member 14 by rivets 20. The intermediate slide member 14 is supported for sliding movement in the stationary slide member 16 by rollers 22 attached to the stationary slide member 16 by rivets 24 and by rollers 26 attached to the rearward end 40 of intermediate slide member 14. These rollers 18, 22, and 26 make it easy for a user to move the slide members 12, 14, 16 relative to one another to move the telescoping slide assembly 10 between a retracted position (shown in FIG. 6) and a fully extended position (shown in FIG. 9).

As illustrated in FIG. 2, the stationary slide member 16 includes a bottom portion 60 positioned between two spaced-apart vertical side walls 62 and arranged to mount on a fixed platform such as a truck bed 13. Horizontal flanges 64 extend inwardly from the vertical side walls 62 to overlie the rollers 22 as shown in FIG. 2. The intermediate slide member 14 includes a bottom portion 66 positioned between two spaced-apart vertical side walls 68. Horizontal flanges 70 extend outwardly from the vertical side wall 68 and are arranged to lie underneath the pair of horizontal flanges 64 of the stationary slide member 16. The horizontal flanges 70 are supported by rollers 22 mounted on the vertical side walls 62 of the stationary slide member 16.

The chassis slide member 12 includes a pair of horizontal load-supporting flanges 72 extending outwardly in opposite directions from an upper end of abutting central vertical walls 74. The piece of equipment 15 to be carried by telescoping slide assembly 10 is mounted on the load-supporting flanges 72 as shown best in FIG. 2. Bottom flanges 76 lie in spaced-apart parallel relation to the upper flanges 72 and extend outwardly in opposite directions from a lower end of the central vertical walls 74. The horizontal load supporting flanges 72 are supported by the rollers 18 mounted on the vertical side walls 68 of the intermediate slide member 14.

The vertical side walls 62 of the stationary slide member 16 are sized to allow the rollers 22 to support the horizontal flange 70 of the intermediate slide member 14 for back and forth movement in a plane between the horizontal flange 64 and the roller 22. The vertical side walls 68 of the intermediate slide member 14 are sized to allow rollers 18 to support the horizontal load-supporting flanges 72 of the chassis slide member 12 while allowing the bottom flanges 76 of the chassis slide member 12 to lie between the rollers 18 and the bottom portion 66 of the intermediate slide member 14.

It is inconvenient to use a telescoping slide assembly that automatically locks to establish a locked partly extended position during movement of the slide members from the fully extended position to a fully retracted position. Although it is expected that it will be necessary to actuate a first release mechanism to unlock the slide members so that they can be moved from a fully extended position toward a fully retracted position, it is a nuisance to operators if they have to actuate a second release mechanism to release the slide members from a locked partly extended position. Therefore, a mechanism that could be added to a telescoping slide assembly to keep it from stopping and locking at a partly extended position would be welcomed by users of slide assemblies.

Figure 3:
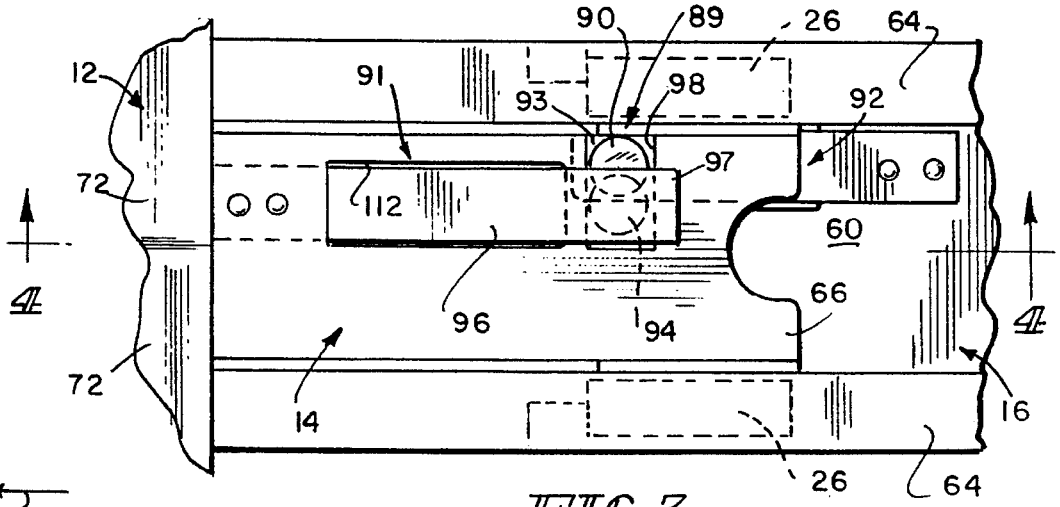
FIG. 3 is a plan view of a portion of the intermediate and stationary slide members taken along line 3—3 of FIG. 1 showing a first embodiment of a locking mechanism for locking the intermediate slide member in a fully extended position relative to the stationary slide member and unlocking a companion mechanism for automatically unlocking the locking mechanism during rearward movement of the chassis slide member relative to the intermediate and stationary slide members.
Figure 4:
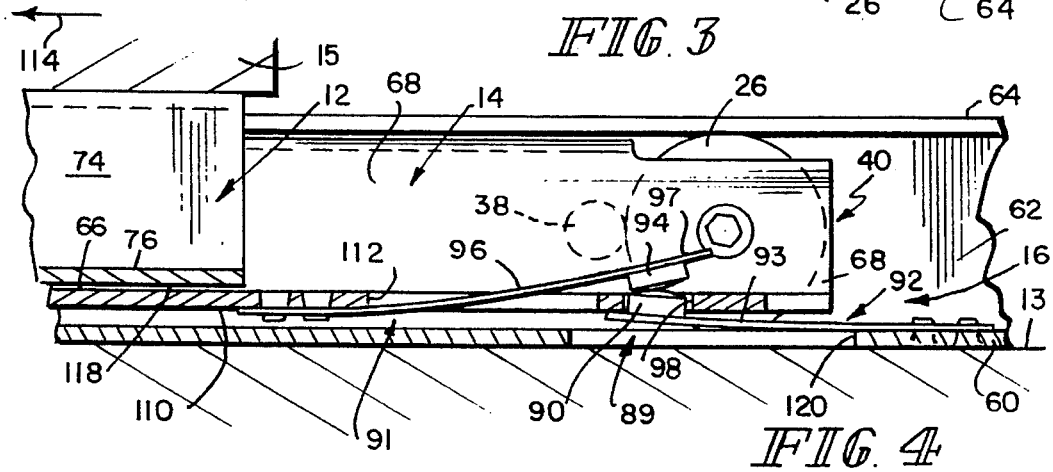
FIG. 4 is a sectional view taken along lines 4—4 in FIG. 3 showing the locking and unlocking mechanisms in more detail and specifically a locked connection wherein a lower button carried on a spring strip fits up into an aperture formed in the intermediate slide member to lock the intermediate slide member in a fully extended position relative to the stationary slide member.
Figure 5:
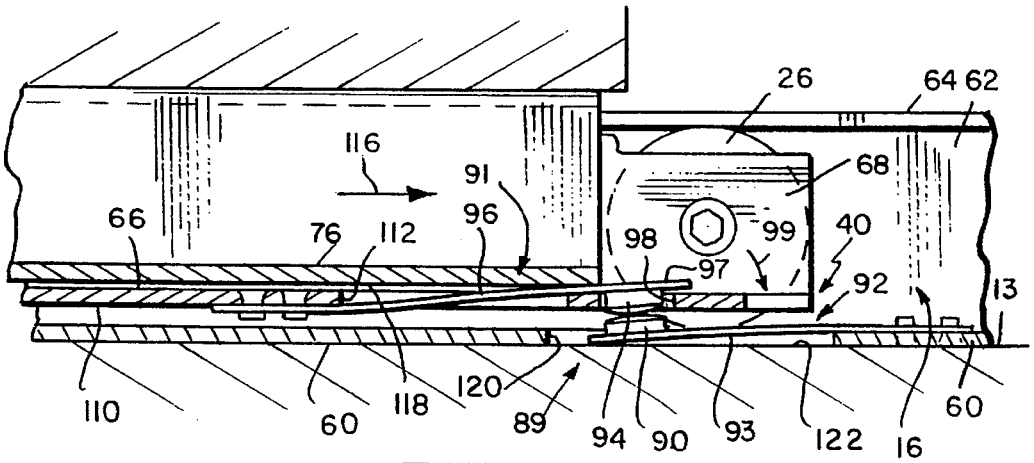
FIG. 5 is a sectional view similar to FIG. 4 showing the operation of the unlocking mechanism and specifically an unlocked connection wherein an upper button carried on a second spring strip is forced downwardly as the rearwardly moving chassis slide member bears against this second spring strip to force the lower first button down out of the aperture in the intermediate slide member, thereby allowing the intermediate slide member to move to the right relative to the stationary slide member and with the chassis member toward a fully retracted home position.
Figure 10:
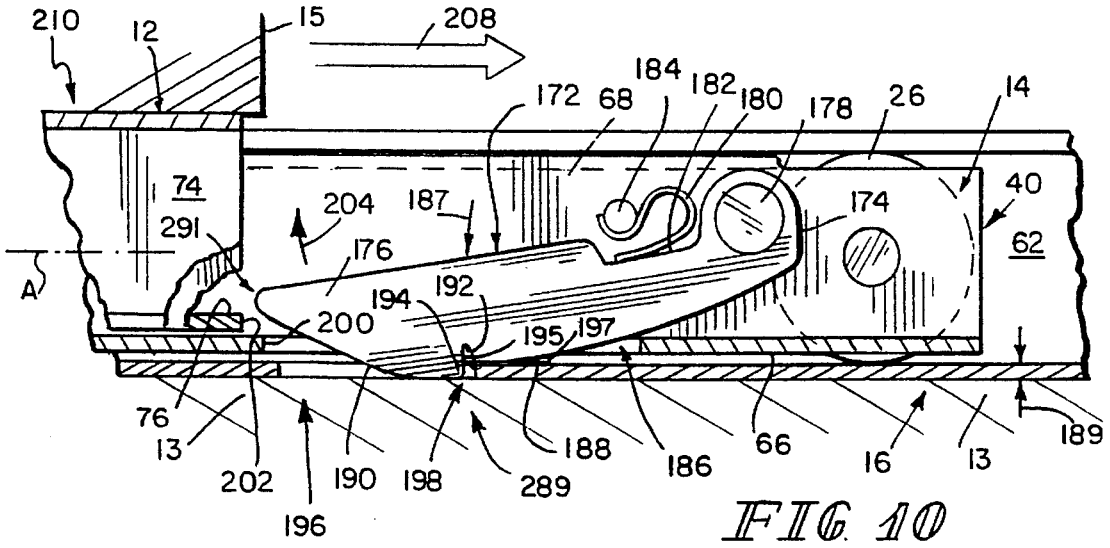
FIG. 10 is a view similar to FIG. 4 showing an alternative embodiment of a locking and unlocking mechanism including a latch blade that is pivotally mounted on the intermediate slide member and arranged to extend through an aperture formed in the intermediate slide member to engage a lip formed in the stationary slide member to lock the intermediate slide member in a fully extended position relative to the stationary slide member.
Figure 11:
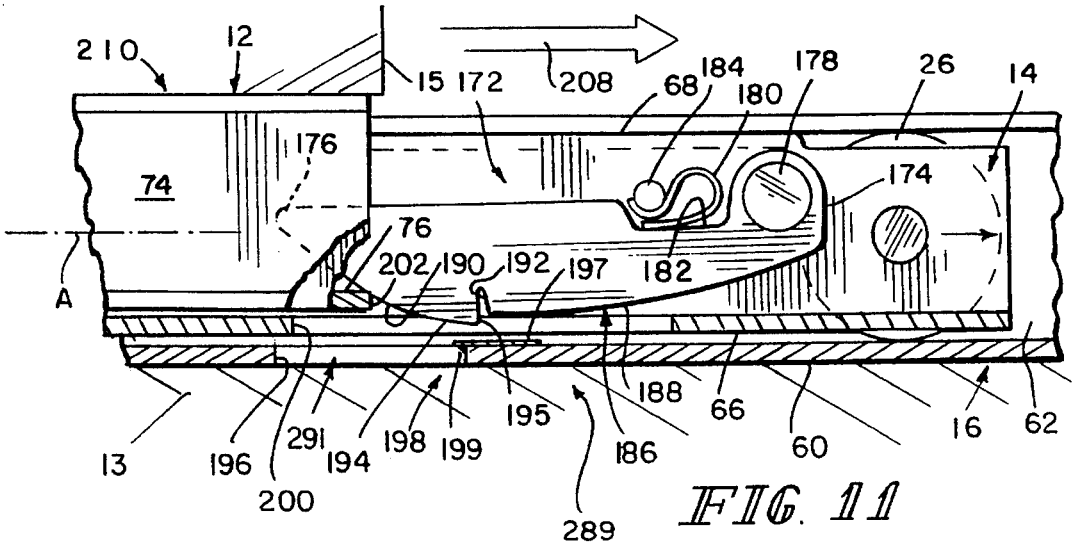
FIG. 11 is a sectional view similar to FIG. 10 showing the mechanism of FIG. 10 in an unlocked configuration wherein a forwardly-facing camming edge formed on the chassis slide member engages a forwardly-facing ramping surface formed on the latch blade to lift and pivot the latch blade upwardly away from the stationary slide member to disengage the latch blade from the lip in the stationary slide member, thereby allowing the intermediate slide member to move with the chassis member to the right relative to the stationary slide member toward a fully retracted position.

One locking mechanism 89 for locking the intermediate slide member 14 in a fully extended position relative to the stationary slide member 16 is illustrated in FIGS. 3–5. Portions of this locking mechanism 89 are also visible in FIG. 1 near the left-hand end of the stationary slide member 16. An alternative latch mechanism 289 that can be used in lieu of locking mechanism 89 is illustrated in FIGS. 10 and 11. One feature of the present invention is the provision of means 91 (or 291, FIG. 10) for automatically unlocking the locking mechanism 89 (or 289, FIG. 10) in response to movement of the chassis slide member 12 from its fully extended position toward its fully retracted position. Advantageously, it is not necessary for a user to unlock the locking mechanism 89 (or latch mechanism 289) manually whenever the telescoping slide assembly 10 (or telescoping slide assembly 210) is extended or retracted.

Referring now to FIGS. 3–5, locking mechanism 89 includes a first button 90 and a strip of spring material 92. The first button 90 is attached to a free end 93 of first spring 92 and a fixed end of first spring 92 is attached to the bottom portion 60 of the stationary slide member 16 as shown in FIGS. 3 and 4. The first spring 92 is aligned so that its free end 93 moves easily into and out of a first spring-receiving aperture 120 formed in bottom portion 60 of the stationary slide member 16.

The unlocking mechanism 91 includes a second button 94 arranged to project downwardly to contact the upwardly projecting first button 90. The second button 94 is attached to a second strip of spring material 96 which has a fixed end that is fastened to the bottom portion 66 of the intermediate slide member 14.

As shown best in FIG. 4, the free end 93 of first spring 92 is positioned to align the first button 90 so that it will fit into a button-receiving aperture 98 formed in the bottom portion 66 of the intermediate slide member 14 during sliding movement of the intermediate slide member 14 relative to the stationary slide member 16. The first spring 92 is biased normally to urge the first button 90 into the button-receiving aperture 98 whenever the intermediate slide member 14 reaches its fully extended position relative to the stationary slide member 16 to lock the intermediate slide member 14 in that extended position.

The fixed end of second button spring 96 is fastened to the underside 110 of the bottom portion 66 of the intermediate slide member 14 as shown in FIG. 4. A middle section of second spring 96 is arranged to pass through a second spring-receiving aperture 112 formed in the bottom portion 66, so that a free end 97 of second spring 96 is arranged to position the second button 94 in confronting relation to the first button 90. The second spring 96 is biased to urge the second button 94 downwardly into contact with the underlying first button 90 whenever their paths cross as shown in FIGS. 3–5. However, the biasing force generated by the second spring 96 is not sufficient by itself to displace the first button 90 and move the first button 90 out of the button-receiving aperture 98 formed in the intermediate slide member 14.

Movement of the chassis slide member 12 in the direction of arrow 114 toward its fully extended position allows the first and second button springs 92, 96 to assume their normal positions, wherein the first button 90 is projected by first spring 92 into the button-receiving aperture 98 and is placed in contact with the second button 94 as shown in FIG. 4. The spring force generated by first spring 92 is greater than the spring force generated by second spring 96 to cause the first button 90 to fit into the button-receiving aperture 98 and effectively displace the second button 94 so that it does not fit in the button-receiving aperture 98. Nevertheless, the second spring 96 does generate enough spring force to maintain the second button 94 generally in contact with the first button 90 regardless of the relative positions of the intermediate slide member 14 and the stationary slide member 16.

Movement of the chassis slide member 12 in direction of arrow 116 toward a retracted position, as illustrated in FIG. 5, actuates the unlocking mechanism 91 to cause the locking mechanism 89 to disengage the intermediate slide member 14 automatically. The underside 118 of the bottom flange 76 of the chassis slide member 12 engages the middle section of the second button spring 96 and deflects the free end 97 of spring 96 downwardly in direction 99 forcing the second button 94 to push the first button 90 out of engagement with the button-receiving aperture 98. When the first button 90 is clear of button-receiving aperture 98, the intermediate slide member 14 is free to retract in direction of arrow 116. As the intermediate slide member 14 continues to retract, the first button 90 is held in position in the first spring-receiving aperture 120 by the underside 110 of bottom flange 66 of the intermediate slide member 14.

Advantageously, the first button 90 and first button spring 92 fit within the volume defined by the underside 110 of the bottom portion 66 of the intermediate slide member 14, the first button-receiving aperture 120, and the top surface 122 of the platform 13 that supports the telescoping slide assembly 10. Therefore, the locking mechanism 89 and companion unlocking mechanism 91 can be mounted on a platform without the need for alterations to the platform 13 to accommodate the first button spring 92.

As shown in FIGS. 10–11, a slide assembly 210 is provided with an alternative embodiment to the locking mechanism 89 and includes a latch blade 172 having a rearward end 174 and a forward end 176. The rearward end 174 is pivotally attached to the vertical side wall 68 of the intermediate slide member 14 by pivot pin 178. A biasing spring 180 is attached to the notched top edge 182 of the latch blade 172 and to retaining post 184 and arranged to urge the latch blade 172 downwardly, as viewed in FIGS. 10∝11. Advantageously, the size of the vertical side walls of latch blade 172 increases the beam strength to withstand loads in excess of 1000 pounds.

The latch blade 172 includes a bottom surface 186 having two curved sections 188 and 190. The first curved section 188 extends forwardly from the rearward end 174 of the latch plate 172 to a notch 192 formed in the bottom surface 186 of the latch blade 172. The second curved section 190 extends rearwardly from the forward end 176 toward the rearward end 174 and terminates at an engaging tip 194 formed at the juncture between the second curved section 190 and the notch 192. The engaging tip 194 extends downwardly below the first curved section 188 of the bottom surface 186, as shown best in FIG. 10, by an amount substantially equal to the thickness 189 of the bottom portion 60 of the stationary slide member 16.

An aperture 196 is formed in the bottom surface 60 of the stationary slide member 16 for receiving the latch blade 172 following pivoting movement of latch blade 172 about pivot pin 178 in direction 187. A blade access aperture 200 is formed in the bottom surface 66 of the intermediate slide member 14 and positioned to allow the latch blade 172 to pass therethrough and enter the aperture 196 formed in the stationary slide member 16. A downwardly and forwardly facing, beveled, blade-engaging lip 198 is formed on one edge of the aperture 196 for contacting the engaging tip 194 provided on latch blade 172. A thin plate 197 is attached to stationary slide member 16 as shown best in FIG. 11. A strip of weldment 199 is deposited under the overhanging portion of thin plate 197 to form the beveled lip 198. The engaging tip 194 on latch blade 172 extends downwardly and rearwardly and is sized to fit under the beveled lip 198 to provide positive means for locking the intermediate slide member 14 to the stationary slide member 16 whenever the latch blade 172 is pivoted downwardly to pass into the blade-receiving aperture 196 formed in the stationary slide member 16.

When the slide assembly 210 is an extended position, as shown in FIG. 10, the slide members 12, 14, and 16 are positioned to allow the spring-biased latch blade 172 to pivot in direction 187 and pass through the blade access aperture 200 formed in the intermediate slide member 14 and enter the blade-receiving aperture 196 formed in the stationary slide member 16. Biasing spring 180 urges the latch blade 172 downwardly in direction 187 to position the engaging tip 194 under the beveled lip 198 on the stationary slide member 16.

As shown best in FIG. 10, the engaging tip 194 is configured to present a parallel, abutting surface 195 to the inclined engaging lip 198. Advantageously, when engaged, the engaging lip 198 and abutting surface 195 are oriented to lie at an acute angle to the longitudinal axis A of the slide assembly 210 and thereby greatly reduce the likelihood of inadvertent release of the intermediate slide member 14 relative to the stationary slide member 16. Until the latch blade 172 is lifted or pivoted in direction 204 relative to the stationary slide member 16, attempted retraction of the intermediate slide member 14 relative to the stationary slide member 16 only drives the latch blade 172 downwardly in direction 187, wedging the engaging tip 194 on latch blade 172 beneath the bevelled lip 198 on the stationary slide member 16. The bevelled lip 198 provides a catch against the engaging tip 194 holding the latch blade 172 in the locked position as shown in FIG. 10 to prevent inadvertent retraction of the intermediate slide member 14 relative to the stationary slide member 16.

Thus, a positive lifting force must be applied to the latch blade 172 to cause the engaging tip 194 to disengage the bevelled lip 198 and to release the intermediate slide member 14 for retraction in direction 208 relative to the stationary slide member 16. Retraction of the chassis slide member 12 in direction 208 brings the rearmost camming edge 202 of the bottom flange 76 of the chassis slide member 12 into contact with the ramping surface 190 on a leading edge of latch blade 172. As the chassis slide member 12 continues to move in retracting direction 208, the rearmost camming edge 202 on chassis slide member 12 ramps the forward end 176 of the latch blade 172, lifting the latch blade 172 upwardly in the direction of arrow 204 (FIG. 10). As the latch blade 172 pivots and moves upwardly in direction 204, the engaging tip 194 is lifted out of engagement with the engaging lip 198, allowing the intermediate slide member 14 to retract relative to the stationary slide member 16, as shown in FIG. 11.

By providing the latch blade 172, the present invention requires the chassis slide member 12 to retract relative to the intermediate slide member 14 in order to release the intermediate slide member 14 for retraction relative to the stationary slide member 16. Since retraction of the chassis slide member 16 requires positive movement of the locking lever 52 (shown in FIG. 1 and described in more detail below), the likelihood of inadvertent retraction of the slide assembly 210 is greatly diminished.

A locking lever 52 is mounted on the chassis slide member 12 as shown in the FIGS. 1 and 6–9. This locking lever 52 is pivotable to control locking of the chassis slide member 12 to the intermediate slide member 14. The locking lever 52 is arranged as shown best in FIG. 1 to be accessible to an operator able to reach the front end 53 of the telescoping slide assembly 10.

The locking lever 52 includes an elongated handle portion 130 and a blade portion 132 as shown in detail in FIGS. 6–9. Rivet 80 pivotally couples the handle portion 130 of the locking lever 52 to the abutting central vertical walls 74 of the chassis slide member 12. The locking lever 52 is positioned so that a distal end portion 134 extends beyond the distal end 32 of the chassis slide member 12. The blade portion 132 includes a triangular lug 138 and an oblong lug 139 as shown best in FIG. 6. These locking lugs 138, 139 cooperate to lock the slide members 12, 14, 16 in various positions as shown in FIGS. 6–9.

A spring 54 is positioned to lie between one of the horizontal load-supporting flanges 72 and the top edge 55 of the locking lever 52 to bias the locking lever 52 normally to the position shown in FIG. 1. The spring 54 includes a precurved portion 57 contacting the horizontal load-supporting flange 72 and a flat blade 59 resting against the top edge 55 of locking lever 52. The spring 54 is situated to lie between the pivot post 80 and the blade portion 132 as shown best in FIG. 6.

Figure 6:
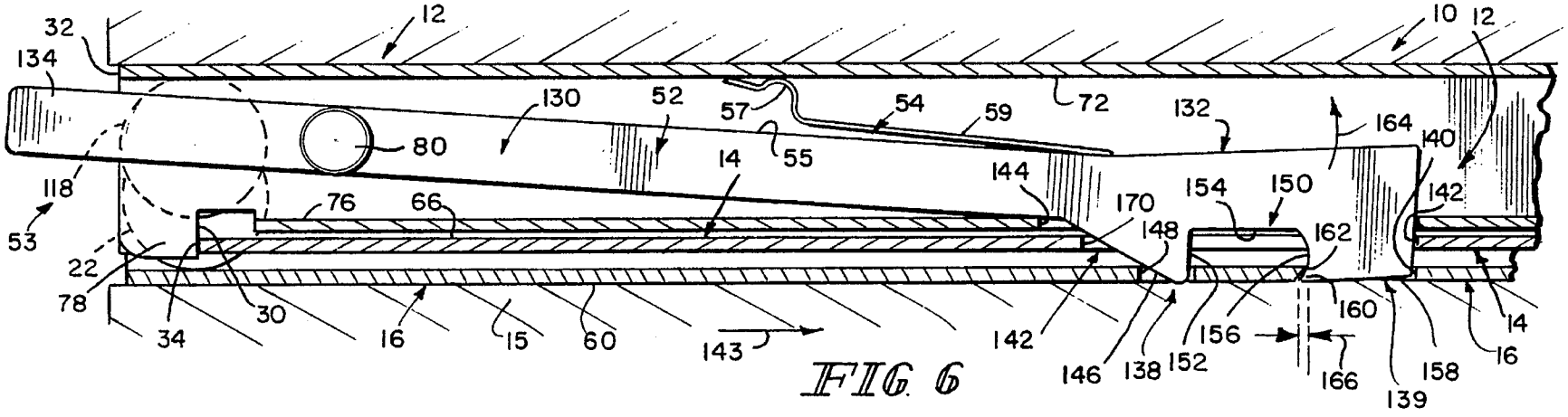
FIG. 6 is a sectional view taken along lines 6—6 of FIG. 2 showing a locking lever engaging various apertures formed in the intermediate and stationary slide members, thereby locking the telescoping slide assembly in its fully retracted position.

When the telescoping slide assembly 10 is in the fully retracted position shown in FIG. 6, first, second, and third rectangular locking apertures 140, 142, 144 formed in the stationary, intermediate, and chassis slide members 16, 14, 12, respectively, are vertically aligned in registry with each other. The blade portion 132 of locking lever 52 is urged downwardly by the action of the spring 54 to engage the locking apertures 140, 142, 144 to lock the telescoping slide assembly 10 in the fully retracted position as shown in FIG. 6. The spring 54 urges the triangular locking lug 138 into apertures 144, 142, and 148 and the oblong locking lug 139 into apertures 144, 142, and 140 to establish the locked condition shown in FIG. 6.

An inclined lifting ramp 146 is provided on a forward facing edge of triangular locking lug 138 as shown in FIG. 6. Lifting ramp 146 fits into the lifting ramp aperture 148 formed in the stationary slide member 16 whenever the telescoping slide assembly is moved to its retracted position. The lifting ramp 146 cooperates with vertical edge 152 to define the triangular shape of locking lug 138 that extends downwardly away from the blade portion 132.

The locking lugs 138, 139 are situated in spaced-apart relation to form a notch 150 therebetween in the blade portion 132 of locking lever 52. The notch 150 is defined by a forward vertical edge 152, a rear curvilinear edge 156, and a horizontal edge 154 extending between the rear curvilinear edge 156 and the forward vertical edge 152. The curvilinear edge 156 of the notch 150 meets a bottom edge 158 of the blade portion 132 as shown in FIG. 6 to form a forwardly extending rounded lip 160. The lip 160 engages a complementary bevelled edge 162 formed on the stationary slide member 16 to define a border edge of the first locking aperture 140.

The first locking aperture 140 is sized and positioned so that when the telescoping slide assembly 10 is fully retracted as shown in FIG. 6, a rear shoulder 50 formed on the blade portion 132 abuts against the rear edges of the first and second locking apertures 140, 142. The lip 160 is just able to swing around and clear the bevelled edge 162 so that an operator is able to push down in direction 143 on the outer end 123 of the locking lever 52 to pivot locking lever 52 and cause the blade portion 132 to move upwardly in direction of arrow 164, and thereby disengage the locking lever 52 from the stationary slide member 16.

Once the blade portion 132 of locking lever 52 has been disengaged from the first locking aperture 140, the intermediate and chassis slide members 12, 14 are free to move together relative to the stationary slide member 16. The slide members 12, 14 can be moved in direction 141 as shown in FIG. 7 to extend the telescoping slide assembly 10.

Figure 8:
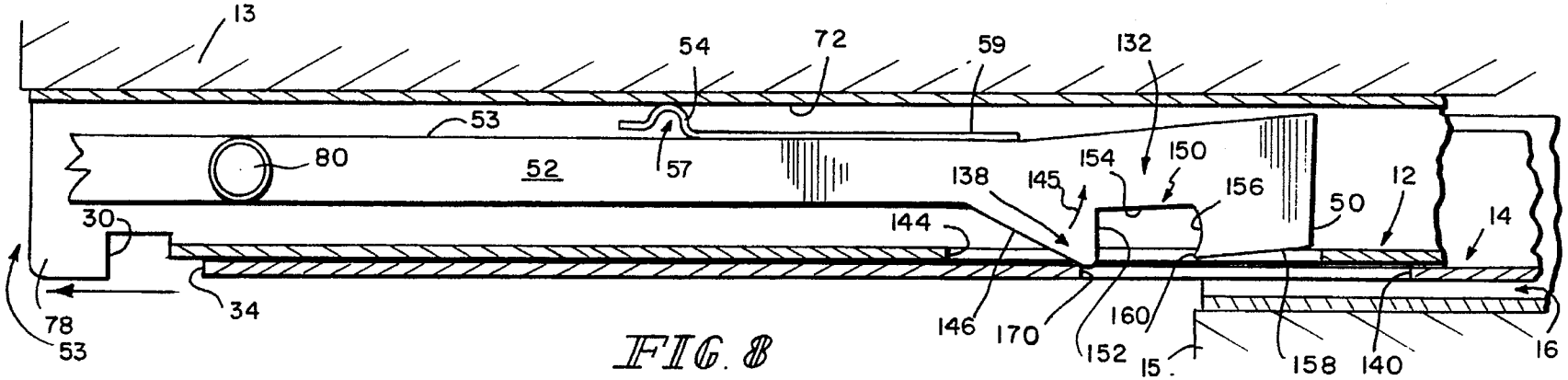
FIG. 8 is a sectional view similar to FIG. 6 showing a lifting ramp provided on the locking lever and configured to block the locking lever from engaging a locking aperture formed in the intermediate slide member, thereby preventing establishment of a locked connection at a partly extended position during extension of the telescoping slide assembly.

When the intermediate slide member 14 has reached its fully extended position as shown in FIG. 4, the first lock button 90 is positioned to engage the lock button-receiving aperture 98 to block further movement of the intermediate slide member 14 relative to the stationary slide member 16. At the same time, the lifting ramp 146 of triangular locking lug 138 engages the forward edge 170 of the second locking aperture 142 formed in the intermediate slide member 14 and lifts the blade portion 132, as shown in FIG. 8. The lifting ramp 146 cams on the bottom portion 66 of the intermediate slide member 14 and keeps the notch 150 from moving downwardly to engage the second locking aperture 142 as also shown in FIG. 8. This camming action by the lifting ramp 146 ensures that the chassis slide member 12 will not lock in any position relative to the intermediate slide member 14 except the fully extended and fully retracted positions.

In operation, the telescoping slide assembly 10 is extended by first ensuring that the assembly 10 is in the fully retracted position as shown in FIG. 6 so as to disengage the lip 160 from the bevelled edge 162 in the first locking aperture 140. Until the chassis slide member 12 is pushed inwardly a bit in direction 143 so as to move the lip 160 the short distance 166 (FIG. 6) in the direction of retraction, the curvilinear edge 156 will continue to engage the bevelled edge 162 and clear the edge 162 of the aperture 140, the operator will be unable to depress the distal end portion 134 to disengage the oblong locking lug 139 and the bevelled edge 162 and release the locking lever 52. Advantageously, this ensures that the operator is capable of handling any force being applied by the equipment mounted to the assembly tending to extend the assembly. If the operator cannot overcome the force applied by the equipment so as to allow the lip 160 to clear the bevelled edge 162, the operator will be unable to release the locking lever 52.

Figure 7:
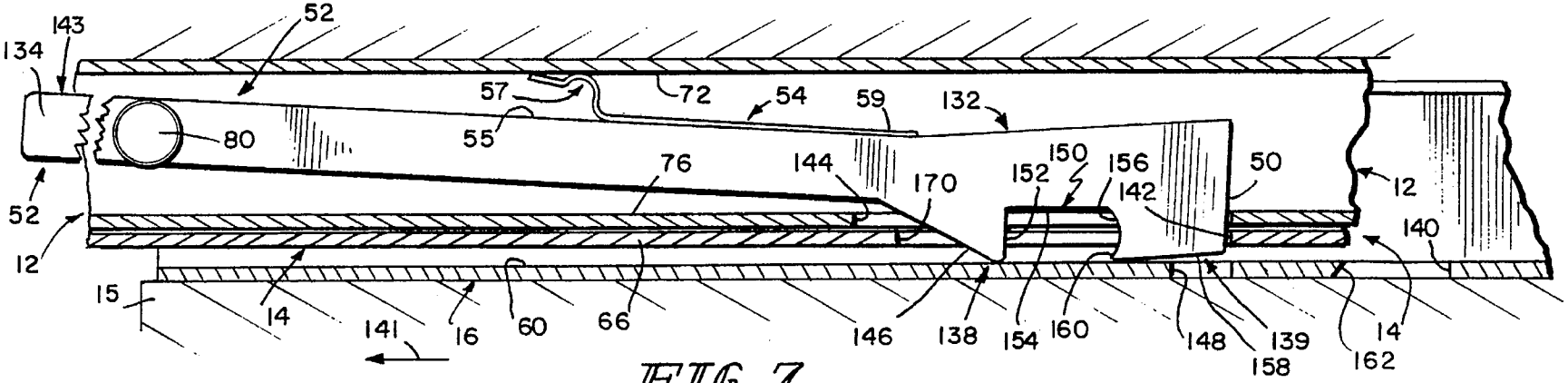
FIG. 7 is a sectional view similar to FIG. 6 showing the position of the locking lever after it has been pivoted in a counterclockwise direction to a release position so that the chassis and intermediate slide members are free to move to the left relative to the stationary slide member toward a fully extended position.

When the locking lever 52 has been disengaged from the first locking aperture 140, the chassis and intermediate slide members 12, 14 are free to extend relative to the stationary slide member 16 and move in direction 141 as shown in FIG. 7. When the intermediate slide member 14 has fully extended, the roller 26 abuts a stop rivet 38 (FIG. 1) appended to an inner wall of stationary slide member 16 to prevent further extension of the intermediate slide member 14 relative to the stationary slide member 16.

Until the chassis slide member 12 extends relative to the intermediate slide member 14, the intermediate slide member 14 is free to retract from the fully extended position. As the chassis slide member 12 extends relative to the intermediate slide member 14, the bottom flange 76 exposes the second button spring 96, as illustrated in FIGS. 3 and 4, allowing the spring 96 to move to its unbiased position. Movement of the second spring 96 to its unbiased position allows the first button spring 92 to urge the first button 90 upwardly into the button-receiving aperture 98, as illustrated in FIG. 4, thereby locking the intermediate slide member 14 to the stationary slide member 16.

As the chassis slide member 12 continues to extend, the locking lever spring 54 urges the blade portion 132 of the locking lever 52 against the bottom portion 66 of the intermediate slide member 14, but the lifting ramp 146 ensures that the locking notch 150 does not engage the second locking aperture 142 in the intermediate slide member 14. Advantageously, the camming action of the lifting ramp 146 eliminates any intermediate stops between the fully retracted and fully extended positions. Thus, the telescoping slide assembly 10 does not lock automatically in any partly extended position.

Figure 9:
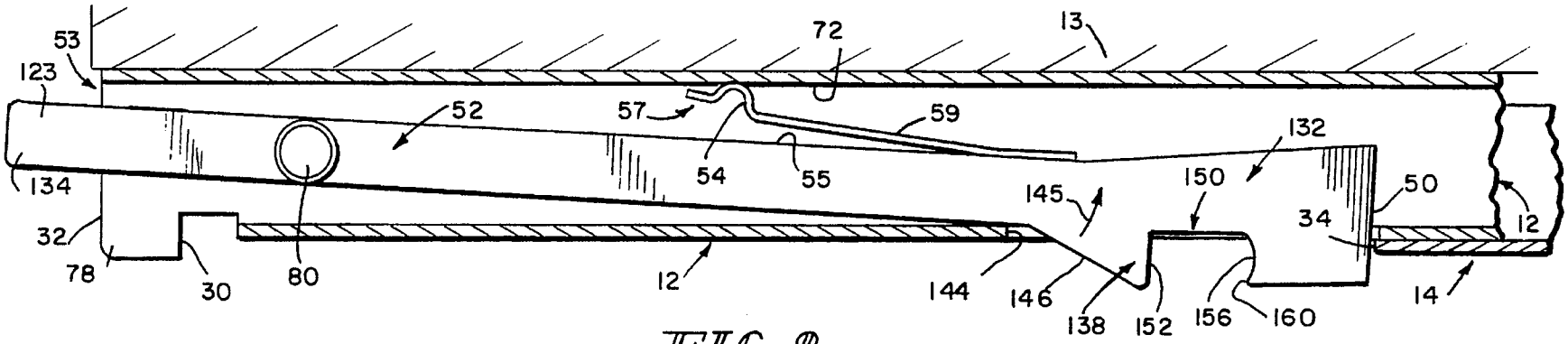
FIG. 9 is a sectional view similar to FIG. 6 showing engagement of a shoulder formed on the locking lever in a notch formed in the intermediate slide member, thereby preventing the chassis slide member moving from its fully extended position toward a retracted position relative to the intermediate slide member.

At the fully extended position, the spring 54 urges the shoulder 50 of the blade portion 132 into engagement with the notch 34 formed in the distal end 36 of the intermediate slide member 14, as illustrated in FIGS. 1 and 9. With the intermediate slide member 14 locked to the stationary slide member 16 by the first locking button 90, and with the chassis slide member 12 unable to retract relative to the intermediate slide member 14 due to the engagement of the shoulder 50 with the notch 34, the telescoping slide assembly 10 is locked in the fully extended position.

From the fully extended position, the assembly 10 is retracted by depressing the forward end portion 123 of the locking lever 52 to lift the blade portion 132 in direction of arrow 145 and disengage the shoulder 50 from the notch 34. Once the shoulder 50 is disengaged from the notch 34, the chassis slide member 12 can retract relative to the intermediate slide member 14 until a downwardly extending shoulder 30 formed on the bottom portion 78 of front edge 53 of the chassis slide member 12 engages the notch 34 formed in the intermediate slide member 14.

As the shoulder 30 approaches the notch 34, the rearward end of the bottom portion 66 of the chassis slide member 12 contacts and depresses the second button spring 96, as illustrated in FIG. 5. Depressing the spring 96 causes the second button 94 to engage the first button 90 and push the first button 90 out of the button-receiving aperture 98 and allow the intermediate slide member 14 to retract relative to the stationary slide member 16. At the same time, the locking lever spring 54 urges the lifting ramp 146 to slide down the distal edge 170 of the second locking aperture 142 in the intermediate slide member 14, as illustrated in FIG. 8. When the shoulder 30 has engaged the notch 34, the blade portion 132 has fully engaged the second locking aperture 142, as illustrated in FIG. 7, thereafter causing the chassis and intermediate slide members 12, 14 to retract together.

Although the invention has been described in detail with reference to certain preferred embodiments, variations and modifications exist within the scope and spirit of the invention as described and defined in the following claims.

What is claimed is:

1. A telescoping slide assembly comprising interconnected load-carrying, intermediate, and stationary slide members movable relative to one another to extend and retract the load-carrying and intermediate slide members relative to the stationary slide member between fully extended and retracted positions, the intermediate slide member moving in a channel formed in the stationary slide member, the load-carrying slide member moving in a channel formed in the intermediate slide member, and the stationary slide member including a latching lip.

means for locking the intermediate slide member to the stationary slide member to prevent relative movement between the intermediate slide member and the stationary slide member upon movement of the intermediate slide member to its fully extended position, the locking means including a latch blade having a blade-pivoting ramp portion, a retraction-blocking latch portion and a base portion pivot means for pivotably mounting the base portion to the intermediate slide member at a pivot point so that the latch blade pivots between a locking position wherein the retraction-blocking latch portion engages the latching lip on the stationary slide member to block movement of the intermediate slide member to its fully retracted position and an unlocking position wherein the retraction-blocking latch portion disengages the latching lip on the stationary slide member to allow movement of the intermediate slide member to its fully retracted position, and spring means for yieldably biasing the latch blade to its locking position engaging the stationary slide member once the intermediate slide member reaches its fully extended position, said spring means being coupled to the intermediate slide member and positioned to lie between the blade-pivoting ramp portion and the pivot point, cam means on the load-carrying slide member for engaging the blade-pivoting ramp portion of the latch blade while the retraction-blocking latch portion engages the latching lip on the Stationary Slide member to pivot the latch blade against the spring means from its locking position to its unlocking position in response to movement of the load-carrying slide member toward its fully retracted position so that the retraction-blocking latch portion on the latch blade disengages the latching lip on the stationary slide member automatically to permit the intermediate slide member to move from its fully extended position toward its fully retracted position, and wherein the latch blade is formed to include a top edge positioned to lie between the blade-pivoting ramp portion and the pivot point, the top edge is formed to include a spring-receiving notch, and the spring means includes a retaining post mounted on the intermediate slide member and a biasing spring having one end coupled to the retaining post and another end extending into the spring-receiving notch formed in the top edge to abut the latch blade.

2. A telescoping slide assembly comprising interconnected load-carrying, intermediate, and stationary slide members movable relative to one another to extend and retracting the load-carrying and intermediate slide members relative to the stationary slide member between fully extended and retracted positions, the intermediate slide member moving in a channel formed in the stationary slide member, the load-carrying slide member moving in a channel formed in the intermediate slide member, a latch blade pivotably coupled to the intermediate slide member the latch blade including means for latching the intermediate slide member to the stationary slide member to block movement of the intermediate slide member toward its fully retracted position once it reaches its fully extended position and latch-release means for preventing the latching means from latching the intermediate slide member to the stationary slide member in response to movement of the load-carrying slide member relative to the intermediate slide member and pivoting movement of the latch blade caused by engagement of the latch blade with the moving load-carrying slide member, wherein the stationary slide member includes a latching lip and the latch-release means includes a blade-pivoting ramp portion on the latch blade and the latching means includes a retraction-blocking latch portion on the latch blade a base portion on the latch blade, pivot means for pivotably mounting the base portion to the intermediate slide member at a pivot point so that the latch blade pivots between a locking position wherein the retraction-blocking latch portion engages the latching lip on the stationary slide member to block movement of the intermediate slide member to its fully retracted position and an unlocking position wherein the retraction-blocking latch portion disengages the latching lip on the stationary slide member to allow movement of the intermediate slide member to its fully retracted position, wherein the latching means further includes spring means for yieldably biasing the latch blade to its locking position engaging the stationary slide member once the intermediate slide member reaches its fully extended position, and wherein the latch-release means includes cam means on the load-carrying slide member for engaging the blade-pivoting ramp portion on the latch blade while the retraction-blocking latch-portion engages the latching lip on the stationary slide member to pivot the latch blade against the spring means from its locking position to its unlocking position in response to movement of the load-carrying slide member toward its fully retracted position so that the retraction-blocking latch portion on the latch blade disengages the latching lip on the stationary slide member automatically to permit the intermediate slide member to move from its fully extended position toward its fully retracted position.

3. The assembly of claim 2 wherein the spring means is coupled to the intermediate slide member and positioned to lie between the blade-pivoting ramp portion and the pivot point.

4. The assembly of claim 3, wherein the latch blade is formed to include a top edge positioned to lie between the blade-pivoting ramp portion and the pivot point, the top edge is formed to include a spring-receiving notch, and the spring means includes a retaining post mounted on the intermediate slide member and a biasing spring having one end coupled to the retaining post and another end extending into the spring-receiving notch formed in the top edge to abut the latch blade.

5. The assembly of claim 3, wherein the latch blade includes a vertical side wall lying between the intermediate slide member and the load-carrying slide member and a top edge lying in perpendicular relation to the vertical side wall, the top edge is formed to include a spring-receiving notch, and the spring means extends into the spring-receiving notch and engages a portion of the top edge in the spring-receiving notch.

6. A telescoping slide assembly comprising interconnected load-carrying, intermediate, and stationary slide members movable relative to one another to extend and retracting the load-carrying and intermediate slide members relative to the stationary slide member between fully extended and retracted positions, the intermediate slide member moving in a channel formed in the stationary slide member, the load-carrying slide member moving in a channel formed in the intermediate slide member, a latch blade pivotably coupled to the intermediate slide member, the latch blade including means for latching the intermediate slide member to the stationary slide member to block movement of the intermediate slide member toward its fully retracted position once it reaches its fully extended position and latch-release means for preventing the latching means from latching the intermediate slide member to the stationary slide member in response to movement of the load-carrying slide member relative to the intermediate slide member and pivoting movement of the latch blade caused by engagement of the latch blade with the moving load-carrying slide member, wherein the stationary slide member includes a latching lip and the latch-release means includes a blade-pivoting ramp portion on the latch blade, and the latching means includes a retraction-blocking latch portion on the latch blade, a base portion on the latch blade, pivot means for pivotably mounting the base portion to the intermediate slide member at a pivot point so that the latch blade pivots between a locking position wherein the retraction-blocking latch portion engages the latching lip on the stationary slide member to block movement of the intermediate slide member to its fully retracted position and an unlocking position wherein the retraction-blocking latch portion disengages the latching lip on the stationary slide member to allow movement of the intermediate slide member to its fully retracted position, wherein the latching means further includes spring means for yieldably biasing the latch blade to its locking position engaging the stationary slide member once the intermediate slide member reaches its fully extended position, and wherein the spring means is coupled to the intermediate slide member and positioned to lie between the retraction-blocking latch portion and the pivot point.

7. The assembly of claim 6, wherein the latch blade is formed to include a top edge positioned to lie between the retraction-blocking portion and the pivot point, the top edge is formed to include a spring-receiving notch, and the spring means includes a retaining post mounted on the intermediate slide member and a biasing spring having one end coupled to the retaining post and another end extending into the spring-receiving notch formed in the top edge to abut the latch blade.

8. A telescoping slide assembly comprising interconnected load-carrying, intermediate, and stationary slide members movable relative to one another to extend and retract the load-carrying and intermediate slide members relative to the stationary slide member between fully extended and retracted positions, the intermediate slide member moving in a channel formed in the stationary slide member, the load-carrying slide member moving in a channel formed in the intermediate slide member, and the stationary slide member including a latching lip, means for locking the intermediate slide member to the stationary slide member to prevent relative movement between the intermediate slide member and the stationary slide member upon movement of the intermediate slide member to its fully extended position, the locking means including a latch blade having in series a blade-pivoting ramp portion next to a retraction-blocking latch portion, next to a base portion, pivot means on the base portion for pivotably mounting the base portion to the intermediate slide member at a pivot point so that the latch blade pivots between a locking position wherein the retraction-blocking latch portion engages the latching lip on the stationary slide member to block movement of the intermediate slide member to its fully retracted position and an unlocking position wherein the retraction-blocking latch portion disengages the latching lip on the stationary slide member to allow movement of the intermediate slide member to its fully retracted position, and spring means for yieldably biasing the latch blade to its locking position engaging the stationary slide member once the intermediate slide member reaches its fully extended position, cam means on the load-carrying slide member for engaging the blade-pivoting ramp portion of the latch blade while the retraction-blocking latch portion engages the latching lip on the stationary slide member to pivot the latch blade against the spring means from its locking position to its unlocking position in response to movement of the load-carrying slide member toward its fully retracted position so that the retraction-blocking latch portion on the latch blade disengages the latching lip on the stationary slide member automatically to permit the intermediate slide member to move from its fully extended position toward its fully retracted position.

9. The assembly-of claims 8, wherein the spring means is coupled to the intermediate slide member and positioned to lie between the blade-pivoting ramp portion and the pivot point.

10. The assembly of claim 9, wherein the latch blade is formed to include a top edge positioned to lie between the blade-pivoting ramp portion and the pivot point, the top edge is formed to include a spring-receiving notch, and the spring means includes a retaining post mounted on the intermediate slide member and a biasing spring having one end coupled to the retaining post and another end extending into the spring-receiving notch formed in the top edge to abut the latch blade.

11. The assembly of claim 8, wherein the spring means is coupled to the intermediate slide member and positioned to lie between the retraction-blocking latch portion and the pivot point.

12. The assembly of claim 11, wherein the latch blade is formed to include a top edge positioned to lie between the retraction-blocking portion and the pivot point, the top edge is formed to include a spring-receiving notch, and the spring means includes a retaining post mounted on the intermediate slide member and a biasing spring having one end coupled to the retaining post and another end extending into the spring-receiving notch formed in the top edge to abut the latch blade.

13. The assembly of claim 8, wherein the latch blade includes a vertical side wall lying between the intermediate slide member and the load-carrying slide member and a top edge lying in perpendicular relation to the vertical side wall, the top edge is formed to include a spring-receiving notch, and the spring means extends into the spring receiving notch and engages a portion of the top edge in the spring-receiving notch.

14. The assembly of claim 13, wherein the spring means includes a retaining post mounted on the intermediate slide member and a biasing spring having one end coupled to the retaining post and another end abutting said portion of the top edge in the spring-receiving notch.

15. The assembly of claim 8, wherein the stationary slide member is formed to include a latch blade-receiving aperture and the latching lip is positioned to extend into the latch blade-receiving aperture.

16. The assembly of claim 15, wherein the stationary slide member includes - edge defining a boundary of the latch blade-receiving aperture, the latching lip includes a flat thin horizontal plate having a base portion coupled to the stationary slide member and an-overhanging portion extending into the latch blade-receiving aperture, and the latching lip further includes a beveled portion abutting the overhanging portion and said edge of the stationary slide member.

17. The assembly of claim 8, wherein the stationary slide member is formed to include a latch blade-receiving aperture, the intermediate slide member is formed to include a latch-access aperture positioned to lie adjacent-to the latch blade-receiving aperture formed in the stationary slide member upon movement of the intermediate slide member to its fully extended position, and the spring means yieldably biases the retraction blocking latch member of the latch blade through the latch-access aperture and into the latch blade-receiving aperture and into engagement with the latching lip upon arrival of the intermediate slide member at its fully extended position.

18. The assembly of claim 17, wherein the latch blade is formed to include a latching notch having an opening facing toward the latching lip upon arrival of the intermediate slide member at its fully extended position and the retraction-blocking latch member is situated to define a boundary edge of the latching notch.

19. A telescoping slide assembly comprising vertically nested interconnected load-carrying, intermediate, and stationary slide members-movable relative to one another to extend and retract the load-carrying and intermediate slide members relative to the stationary slide member between fully extended and retracted positions, the intermediate slide member moving horizontally in a channel formed in the stationary slide member, the load-carrying slide member moving horizontally in a channel formed in the intermediate slide member, vertically disposed rollers horizontally axeled on the slide-members, the vertical nesting providing horizontally extending runways on the intermediate and stationary slide members to vertically support the vertical disposed rollers to provide horizontal relative movement between slide members, and the stationary slide member including a latching lip within its runway, means for locking the intermediate slide member to the stationary slide member to prevent relative movement between the intermediate slide member and the stationary slide member upon movement of the intermediate slide member to its fully extended position, the locking means including a latch blade having a blade-pivoting ramp portion, a retraction-blocking latch portion, and a base portion, a horizontally disposed pivot means for pivotably mounting the base portion to the intermediate slide member at a pivot point above its runway so that the latch blade pivots between a locking position wherein the retraction-blocking latch portion moves vertical downward to engage the latching lip on the runway of the stationary slide member to block movement of the intermediate slide member to its fully retracted position and an unlocking position wherein the retraction-blocking latch portion disengages the latching lip on the stationary slide member to allow movement of the intermediate slide member to its fully retracted position, and spring means for yieldably biasing the latch blade to its locking position engaging the stationary slide member once the intermediate slide member reaches its fully extended position, cam means on the load-carrying slide member for engaging the blade-pivoting ramp portion of the latch blade while the retraction-blocking latch portion engages the latching lip on the stationary slide member to pivot the latch blade against the spring means from its locking position to its unlocking position in response to movement of the load-carrying slide member toward its fully retracted position so that the retraction-blocking latch portion on the latch blade disengages the latching lip on the stationary slide member automatically to permit the intermediate slide member to move from its fully extended position toward its fully retracted position.

20. The assembly of claims 19, wherein the spring means is coupled to the intermediate slide member and positioned to lie between the blade-pivoting ramp portion and the pivot point.

21. The assembly of claim 20, wherein the latch blade is formed to include-a top edge positioned to lie between the blade-pivoting ramp portion and the pivot point, the top edge is formed to include a spring-receiving notch, and the spring means includes a retaining post mounted on the intermediate slide member and a biasing spring having one end coupled to the retaining post and another end extending into the spring-receiving notch formed in the top edge to abut the latch blade.

22. The assembly of claim 19, wherein the spring means is coupled to the intermediate slide member and positioned to lie between the retraction-blocking latch portion and the pivot point.

23. The assembly of claim 22, wherein the latch blade is formed to include a top edge positioned to lie between the retraction-blocking portion and the pivot point, the top edge is formed to include a spring-receiving notch, and the spring means includes a retaining post mounted on the intermediate slide member and a biasing spring having one end coupled to the retaining post and another end extending into the spring-receiving notch formed in the top edge to abut the latch blade.

24. The assembly of claim 19, wherein the latch blade includes a vertical side wall lying between the intermediate slide member and the load-carrying slide member and a top edge lying in perpendicular relation to the vertical side wall, the top edge is formed to include a spring-receiving notch, and the spring means extends into the spring receiving notch and engages a portion of the top edge in the spring-receiving notch.

25. The assembly of claim 24, wherein the spring means includes a retaining post mounted on the intermediate slide member and a biasing spring having one end coupled to the retaining post and another end abutting said portion of the top edge in the spring-receiving notch.

26. The assembly of claim 21, wherein the stationary slide member is formed to include a latch blade-receiving aperture and the latching lip is positioned to extend into the latch blade-receiving aperture.

27. The assembly of claim 26, wherein the stationary slide member includes an edge defining a boundary of the latch blade-receiving aperture, the latching lip includes a flat thin horizontal plate having a base portion coupled to the stationary slide member and an overhanging portion extending into the latch blade-receiving aperture, and the latching lip further includes a beveled portion abutting the overhanging portion and said edge of the stationary slide member.

28. The assembly of claim 19, wherein the stationary slide member is formed to include a latch blade-receiving aperture, the intermediate slide member is formed to include a latch-access aperture positioned to lie adjacent to the latch blade-receiving aperture formed in the stationary slide member upon movement of the intermediate slide member to its fully extended position, and the spring means yieldably biases the retraction blocking latch member of the latch blade through the latch-access aperture and into the latch blade-receiving aperture and into engagement with the latching lip upon arrival of the intermediate slide member at its fully extended position.

29. The assembly of claim 19, wherein the latch blade is formed to include a latching notch having an opening facing toward the latching lip upon arrival of the intermediate slide member at its fully extended position and the retraction-blocking latch member is situated to define a boundary edge of the latching notch.

30. A telescoping slide assembly comprising interconnected load-carrying, intermediate, and stationary slide members movable relative to one another to extend and retract the load-carrying and intermediate slide members relative to the stationary slide member between fully extended and retracted positions, the intermediate slide member moving in a channel formed in the stationary slide member, the load-carrying slide member moving in a channel formed in the intermediate slide member, and the stationary slide member including an aperture with a latching lip, means for locking the intermediate slide member to the stationary slide member to prevent relative movement between the intermediate slide member and the stationary slide member upon movement of the intermediate slide member to its fully extended position, the locking means including a latch blade having a blade-pivoting ramp portion, a retraction-blocking latch portion, and a base portion, the retraction-blocking portion having an abutting surface at an extremity thereof, pivot means for pivotably mounting the base portion to the intermediate slide member at a pivot point so that the latch blade pivots between a locking position, wherein the retraction-blocking latch portion extends through the aperture sufficiently to allow the abutting surface thereof to extend behind the latching lip whereby the latch blade is restrained by the interaction of the lip of the stationary slide member engaging the abutting surface to inhibit pivoting to an unlocked position and thus couple the intermediate and the stationary slide member together to block movement of the intermediate slide member to its fully retracted position and an unlocking position wherein the retraction-blocking latch portion disengages the latching lip on the stationary slide member to allow movement of the intermediate slide member-to its fully retracted position, and spring means for yieldably biasing the latch blade to its locking position engaging the stationary slide member once the intermediate slide member reaches its fully extended position, cam means on the load-carrying slide member for engaging the blade-pivoting ramp portion of the latch blade while the retraction-blocking latch portion engages the latching lip on the stationary slide member to pivot the latch blade against the spring means from its locking position to its unlocking position in response to movement of the load-carrying slide member toward its fully retracted position so that the retraction-blocking latch portion on the latch blade disengages the latching lip on the stationary slide member automatically to permit the intermediate slide member to move from its fully extended position toward its fully retracted position.

31. The assembly of claims 30, wherein the spring means is coupled to the intermediate slide member and positioned to lie between the blade-pivoting ramp portion and the pivot point.

32. The assembly of claim 31, wherein the latch blade is formed to include is, a top edge positioned to lie between the blade-pivoting ramp portion and the pivot point, the top edge is formed to include a spring-receiving notch, and the spring means includes a retaining post mounted on the intermediate slide member and a biasing spring having one end coupled to the retaining post and another end extending into the spring-receiving notch formed in the top edge to abut the latch blade.

33. The assembly of claim 30, wherein the spring means is coupled to the intermediate slide member and positioned to lie between the retraction-blocking latch portion and the pivot point.

34. The assembly of claim 33, wherein the latch blade is formed to include a top edge positioned to lie between the retraction-blocking portion and the pivot point, the top edge is formed to include a spring-receiving notch, and the spring means includes a retaining post mounted on the intermediate slide member and a biasing spring having one end coupled to the retaining post and another end extending into the spring-receiving notch formed in the top edge to abut the latch blade.

35. The assembly of claim 30, wherein the latch blade includes a vertical side wall lying between the intermediate slide member and the load-carrying slide member and a top edge lying in perpendicular relation to the vertical side wall, the top edge is formed to include a spring-receiving notch, and the spring means extends into the spring receiving notch and engages a portion of the top edge in the spring-receiving notch.

36. The assembly of claim 35, wherein the spring means includes a retaining post mounted on the intermediate slide member and a biasing spring having one end coupled to the retaining post and another end abutting said portion of the top edge in the spring-receiving notch.

37. The assembly of claim 30, wherein the stationary slide member is formed to include a latch blade-receiving aperture and the latching lip is positioned to extend into the latch blade-receiving aperture.

38. The assembly of claim 37, wherein the stationary slide member includes - edge defining a boundary of the latch blade-receiving aperture, the latching lip includes a flat thin horizontal plate having a base portion coupled to the stationary slide member and - overhanging portion extending into the latch blade-receiving aperture, and the latching lip further includes a beveled portion abutting the overhanging portion and said edge of the stationary slide member.

39. The assembly of claim 30, wherein the stationary slide member is formed to include a latch blade-receiving aperture, the intermediate slide member is formed to include a latch-access aperture positioned to lie adjacent to the latch blade-receiving aperture formed in the stationary slide member upon movement of the intermediate slide member to its fully extended position, and the spring means yieldably biases the retraction-blocking latch member of the latch blade through the latch-access aperture and into the latch blade-receiving aperture and into engagement with the latching lip upon arrival of the intermediate slide member at its fully extended position.

40. The assembly of claim 39, wherein the latch blade is formed to include a latching notch having - opening facing toward the latching lip upon arrival of the intermediate slide member at its fully extended position and the retraction-blocking latch member is situated to define a boundary edge of the latching notch.

* * * * *